United States Patent [19]

Paterson, deceased et al.

[11] 4,143,976

[45] Mar. 13, 1979

[54] WASHING TRAYS

[76] Inventors: Donald M. Paterson, deceased, late of London, England by Ian R. E. Gow, executor, 2-6 Boswell Ct. London WC1N 3PS, England

[21] Appl. No.: 700,814

[22] Filed: Jun. 29, 1976

[30] Foreign Application Priority Data

Jul. 3, 1975 [GB] United Kingdom ..... 28067/75

[51] Int. Cl.[2] ..... B01F 15/02; B01F 5/10

[52] U.S. Cl. ..... 366/165; 366/166

[58] Field of Search ..... 259/4, 18, 36; 134/182, 134/198, 201; 210/519; 366/165, 166

[56] References Cited

U.S. PATENT DOCUMENTS

| | | | |
|---|---|---|---|
| 1,650,009 | 11/1927 | Charleston | 259/18 |
| 2,212,908 | 8/1940 | Mitchell | 259/4 |
| 2,286,351 | 6/1942 | Drucker | 259/4 R |
| 2,438,648 | 3/1948 | Rodack | 259/4 |
| 2,469,825 | 5/1949 | Hornstein | 259/4 R |
| 3,304,063 | 2/1967 | Ranson | 259/18 |
| 3,419,145 | 12/1968 | Celis | 210/519 |
| 3,754,736 | 8/1973 | Statham | 259/18 |

*Primary Examiner*—Robert W. Jenkins
*Attorney, Agent, or Firm*—Darby & Darby

[57] ABSTRACT

A washing tray e.g. for washing photographic sheet material, consisting of a base and upstanding side walls, a weir at one end of the tray, means for introducing one or more streams of liquid into the tray to create a washing reservoir in the tray upstream of the weir and means for draining liquid from the washing tray on the downstream side of the weir. The dimensions of the parts of the tray and the direction of introduction of the stream(s) of liquid are such that currents in the liquid reservoir have a tendency to cover any object floating in the reservoir. This may be achieved by introducing a single stream of liquid into the angle between the base and the side wall most remote from the weir.

5 Claims, 2 Drawing Figures

WASHING TRAYS

BACKGROUND OF THE INVENTION

This invention relates to washing trays.

There are many circumstances in which it is desired to wash or rinse sheet materials. Of particular importance is the washing of sheets of photographic material in order to remove traces of treatment agents. This is conveniently carried out using running water from a suitable water supply which is fed into and drains from a suitable washing tray.

In the case of conventional photographic printing papers, these saturate with water and sink to the base of a washing tray. In the case of resin and polyethylene coated papers, these float. In each case, one side of the sheet material is not adequately washed. Rapid washing of both sides of the sheet material is desirable, especially in the case of hand processing colour printing papers.

SUMMARY OF THE INVENTION

According to the present invention there is provided a washing tray having a base and upstanding side walls, a weir at one end of the tray, means for introducing one or more streams of liquid into the tray to create in the tray upstream of the weir a washing reservoir and means for draining liquid from the washing tray on the downstream side of the weir.

Preferably the dimensions of the parts of the tray and the direction of introduction of the stream(s) of liquid are such that currents in the liquid reservoir have a tendency to cover any object floating in the reservoir, so that floating sheets are moved below the liquid surface and efficiently washed. In order to achieve such a flow pattern in the reservoir, the tray preferably has means for introducing only a single stream of liquid directed into the included angle between the base and the side wall most remote from the weir.

When such a washing tray is used, usually with water, the weir, usually at one end of a rectangular tray, ensures the maintenance of a body of water in the tray which is constantly replenished from the water supply and constantly depleted by overflow over the weir. The flow in that body of water, if the direction of the stream of liquid is into the angle between the base and end wall, generates two strong side currents down the sides of the tray towards the weir and a slacker central current up the center of the tray back towards the fluid inlet. This has the effect of forcing sheet material placed in the body of liquid in the tray downwardly against any tendency to float and so ensures rapid and thorough washing by water passing over both faces of the sheet.

In order to ensure that the sheet material can easily be removed from the tray, and that it does not lie flat against the floor of the reservoir, the base is preferably relieved by a plurality of parallel ribs running along the length of the tray. The tray is preferably sized to accommodate a standard sheet of photographic material of the largest size popularly encountered. Dividers may be provided which for example may be removably set on the base of the tray to divide the tray into a plurality of compartments each of which is then suitable for the receipt of a sheet of photographic material.

The angle at which the water is directed into the angle included between the base and end wall of the tray, in the preferred arrangement, can be varied to secure appropriate flow conditions under a wide range of inlet water pressures and is generally substantially central in the angle between the base and side wall. It is, however, to be noted that other arrangements for introducing liquid may be provided e.g. a manifold debouching into the two corners of the tray remote from the weir.

BRIEF DESCRIPTION OF THE DRAWINGS

The invention is illustrated by way of example with reference to the accompanying drawing in which.

DESCRIPTION OF A PREFERRED EMBODIMENT

Figure 1:
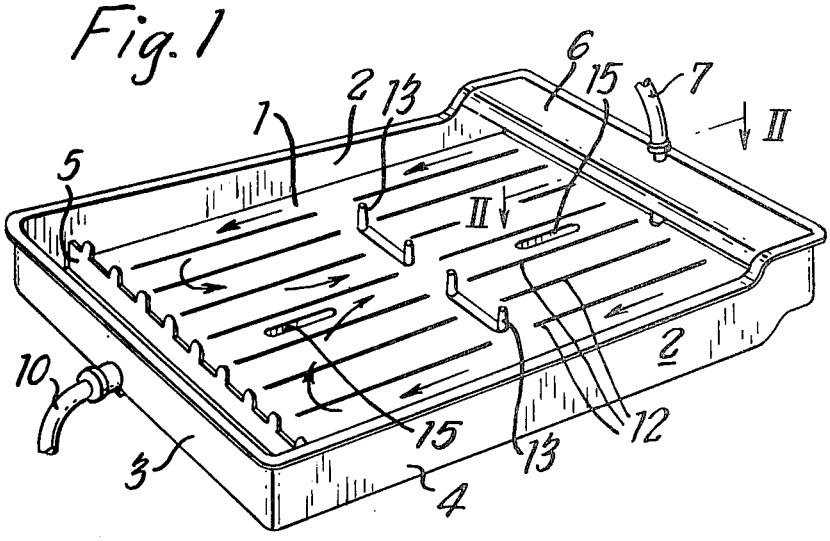
FIG. 1 is a perspective view from above and one side of a print washing tray according to the present invention.
Figure 2:
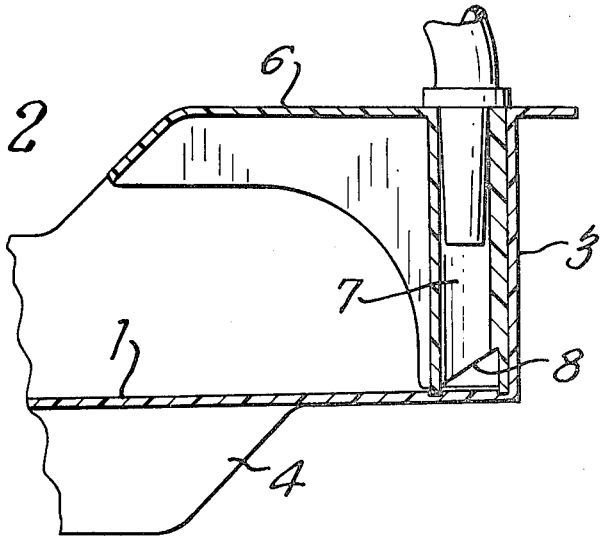
FIG. 2 is a central section through the upper end of the tray along the lines II—II of FIG. 1.

Referring to the drawings the tray which is moulded from plastics material comprises a base 1, side walls 2, end walls 3 and skirt walls 4 which serve to support the tray. When set on a horizontal surface, the base 1 is inclined toward a weir 5 positioned at one end of the tray. Ribs 12 are positioned along the inside surface of base 1. At the end opposite to the weir is a splash guard 6 and a water inlet pipe 7. This pipe has an angled end 8 debouching in the corner between the end wall 3 and base 1. At the end of the tray opposite the water inlet there is a drain outlet 10.

In use the water supply is connected to a tap and the water then flows in the directions as shown by the arrows in the washing reservoir between weir 5 and wall 3 adjacent inlet 7. A sheet of photographic material placed in the tank, even if it tends to float, is gently maintained below the water surface; contact with the bottom is prevented by the ribs 12. If desired spacers 13 (only two of which are shown) may be positioned in fixture slots 15, in which they are press fit, which are moulded in the base of the tray 1 in order to divide the tray into two or four compartments each of which can then be used to wash a smaller sheet of photographic material.

The present invention thus provides a washing tray of simple construction in which the materials are washed efficiently and adequately by being maintained below the water surface by virtue of the flow of water.

From the above description it will be apparent to those skilled in the art that the present invention is capable of taking various useful forms, and it is preferred, therefore, that this disclosure be taken in an illustrative sense, and that the scope of protection afforded be determined by the appended claims.

I claim:

1. In a washing tray for sheet material, having a base, upstanding walls and an inlet near one end, the improvement comprising:

a weir positioned near the other end of the tray and adapted to maintain a liquid reservoir between said weir and said inlet; and an outlet for draining liquid on the downstream side of said weir;

wherein said inlet has an angled end positioned in the angle between said base and the wall most remote from said weir, said angled end being adapted to debouch liquid onto said base and wall and cooperating therewith to cause a downstream current in said reservoir adjacent at least one of said sidewalls, said downstream current being diverted by said weir to cause an upstream current toward said inlet end in the center of said reservoir.

2. A washing tray according to claim 1 wherein the floor of said reservoir inclines upwardly from the intersection of said weir and said base toward said inlet.

3. A washing tray according to claim 1 further comprising:

a plurality of raised ribs positioned on the floor of said reservoir.

4. A washing tray according to claim 1 further comprising:

at least one retainer demountably mounted on the floor of said reservoir and dividing said reservoir into a plurality of sheet-material-retaining areas.

5. A washing tray for sheet material comprising:

an inclined based and upstanding side and end walls extending therefrom;

an inlet positioned substantially along a center line of said tray near the higher end of said tray;

a weir positioned near the lower end of said tray and adapted to maintain a liquid reservoir between said weir and said inlet;

an outlet for draining liquid on the downstream side of said weir;

said inlet having an angled end and a corresponding slanted opening facing the corner between said base and the end wall most remote from said weir, said inlet being adapted to debouch liquid onto said base and said wall and cooperating therewith to cause said liquid to flow along said end wall and to form downstream currents in said reservoir along the side walls of said tray, said downstream currents being diverted by said weir to form an upstream current toward said inlet and along said center line.

* * * * *